United States Patent [19]

Irro

[11] 4,426,165

[45] Jan. 17, 1984

[54] PRINTING DEVICE WITH INTEGRATED PRINT HEAD FASTENING AND ADJUSTMENT

[75] Inventor: Otmar Irro, Feldkirchen, Fed. Rep. of Germany

[73] Assignee: Siemens Aktiengesellschaft, Berlin & Munich, Fed. Rep. of Germany

[21] Appl. No.: 425,447

[22] Filed: Sep. 28, 1982

[30] Foreign Application Priority Data

Dec. 29, 1981 [DE] Fed. Rep. of Germany ..... 3151776

[51] Int. Cl.[3] ..... B41J 29/54; B41J 3/10

[52] U.S. Cl. ..... 400/57; 400/55; 400/124; 400/352; 400/679; 400/692; 101/93.03; 74/568 R

[58] Field of Search ..... 400/55, 56, 57, 58, 400/59, 124, 320, 352, 353, 679, 692, 719, 175; 101/93.03; 74/568

[56] References Cited

U.S. PATENT DOCUMENTS

| | | | |
|---|---|---|---|
| 64,922 | 5/1867 | Strickland | 74/568 |
| 2,156,614 | 5/1939 | Yaeger | 400/55 |
| 4,222,673 | 9/1980 | Plaza et al. | 400/56 |
| 4,381,896 | 5/1983 | Shiurila | 400/59 |

*Primary Examiner*—Edgar S. Burr
*Assistant Examiner*—David A. Wiecking
*Attorney, Agent, or Firm*—Hill, Van Santen, Steadman & Simpson

[57] ABSTRACT

For use in a printing machine, such as an office typewriter, employing a replaceable printing head to be mounted on a carriage, there is provided a printing head fastening arrangement for releasably clamping the printing head to the carriage and permitting adjustable spacing of the printing head relative to the cooperating print support for containing the recording medium. The inventive arrangement enables the fastening and adjustment function to be integrated such that both functions can be carried out in one step. To this end, a rotatable pin is disposed upstanding from the carriage and provided with an operating element, which is resiliently seated relative to the printing head, for selectively engaging against a support surface formed on the printing head to clamp the printing head against the carriage. An eccentric is also disposed on the pin which engages against the walls of a recess formed in the printing head, such that rotation of the pin and operating element causes the eccentric to relatively displace the printing head along the carriage toward or away from the print support.

10 Claims, 2 Drawing Figures

PRINTING DEVICE WITH INTEGRATED PRINT HEAD FASTENING AND ADJUSTMENT

BACKGROUND OF THE INVENTION

The invention relates to a printing machine, such as an office typewriter, in which a printing head device is disposed on a carriage and, more particularly, a fastening arrangement for releasably fastening the printing head to the carriage permitting adjustment of the spacing between the printing head and the cooperating recording medium support.

It is known in printing machines to provide respectively separate operating mechanisms for fastening a printing head to a carriage and for setting the operational spacing between the printing head and the recording medium support. The operating mechanisms for fastening the printing head to the carriage typically, for example, comprise a clamp device with which the printing head is secured to the carriage or, as needed, can be released therefrom. The setting of various spacing distances between the printing head and the cooperating recording medium or print support depends on the thickness of the recording medium being printed, typically paper, and/or on the number of print copies desired. Manufacturing tolerances occurring in the printing head also have an affect on the possible allocation of spacing between the printing head and the cooperating print support. Typically, a basic adjustment is first undertaken which compensates for the manufacturing tolerances and sets a predetermined, defined spacing between the printing head and the cooperating print support. This basic adjustment is carried out by the manufacturing factory and it is a factory adjustment which is difficult for the user or customer to vary. The user or customer can only change the factory adjusted spacing between the printing head and the cooperating print support, which is rigidly preset, by means of makeshift undertakings.

A printing machine having the typical printing head fastening device and employing makeshift customer adjustments exhibits considerable disadvantages. The customer adjustment is usually very involved, since it can frequently be only carried out with auxiliary tools, such as, for example, a wrench for loosening specific parts in the printing machine. As a result, a number of loose parts result which can be easily lost and such action by the customer is time-consuming and cumbersome.

An object of the present invention is to provide a printing head fastening and adjustment system which eliminates the above disadvantages and which can be operated in a simple and intended manner.

SUMMARY OF THE INVENTION

The printing head of a printing machine is provided with a mechanical arrangement for releasably fastening the printing head to its carriage and also permitting variable adjustment of the relative spacing between the printing head and print support. The inventive system comprises a bearing or pin member rotatably secured to and upstanding from the carriage and which has a rigid connection to an operating element resiliently seated on a support surface of the printing head. The operating element engages over an eccentric for attachment and locking engagement with the printing head which is displaceably mounted on the carriage. In accordance with the preferred embodiment, the eccentric is disposed on the pin or bearing element and engages into a skeleton framework provided on the printing head.

By virtue of the present inventive arrangement, printing head fastening and desired customer adjustment may be carried out in a simple operation. When necessary, the customer may readily replace the printing head in a manner which does not result in the handling of a number of loose parts, which could be lost. In addition, the printing head is secured to the carriage without play as the result of the resiliently seated operating element. Furthermore, the insertion of an ink ribbon is greatly facilitated in that the inventive arrangement permits the customer to set the printing head a relatively large distance away from the cooperating print support.

DESCRIPTION OF THE PREFERRED EMBODIMENT

Figure 1:
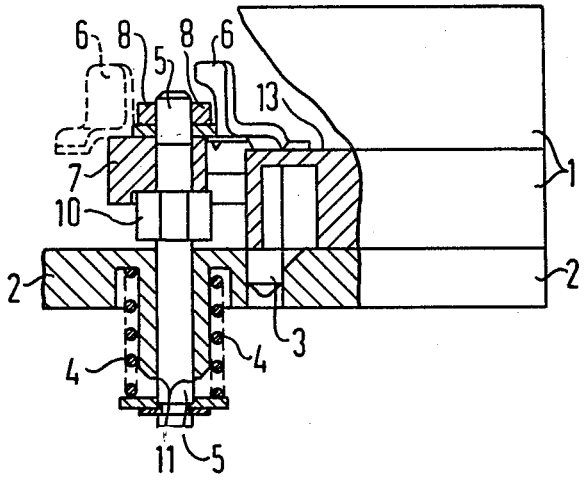
FIG. 1 is a partly schematic, cross-sectional side elevational view of the fastening and adjustment system for a printing head constructed in accordance with the present invention.
Figure 2:
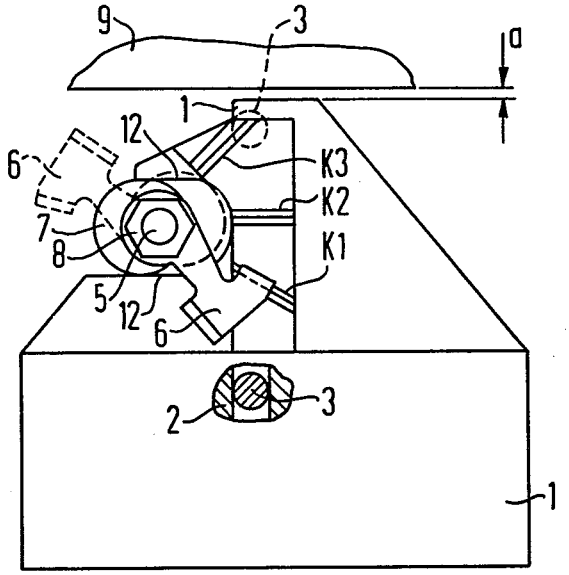
FIG. 2 is a partly schematic, plan view of the fastening and adjustment system of FIG. 1.

FIGS. 1 and 2 illustrate a printing head 1, which, for example, may be a known mosaic-type printer, and a part of a carriage means 2 employed in a conventional printing machine, such as an office typewriter, data typewriter, or teletypewriter. Suitable pegs 3 are formed on the undersurface of the printing head 1 to be received in one or more elongated guideways formed on the carriage 2.

For enabling fastening and relative adjustment of the mounting of the printing head on the carriage, a bearing element or pin 5 is disposed upstanding from the carriage 2 and disposed for rotation relative to the carriage frame. The bearing element 5 is mounted at its lower end in a vertical bore 11 formed in the carriage. The upper free end of the bearing element 5 is rigidly connected to a transversely extending operating element 6, which is in the form of a spring lever member having a free end for resiliently seating or clamping against a support surface 13 formed on the printing head 1. The operating element 6 is biased toward the carriage by virtue of a resilient force means acting against the lower end of the pin 5.

The resilient force means comprises a spring element 4, which may be, for example, in the form of a compression spring, a leaf spring, or a Belleville spring washer, acting between the undersurface of the carriage 2 and a stop plate disposed outward from the lower end of the pin 5. This lower end of the pin 5 projects out of the lower end of the carriage bore 11. As shown in the Figures, the spring element 4 is in the form of a compression spring which surrounds the lower end of the bearing element 5 in the area of the bore 11.

In order to fasten the printing head 1 to the carriage 2, the bearing element 5, including the operating element 6, is partly withdrawn upward from the bore 11 so that the compression spring 4 is compressed. Then, the operating element 6 is disposed against the support surface 13 of the printing head 1 such that the printing head is firmly gripped or clamped thereby against the upper surface of the carriage 2. The pegs 3 extending from the printing head 1 are also disposed in the guideways of the carriage to assist in the mounting of the printing head onto the carriage.

In order to permit adjustable setting of the spacing between the printing head 1 and a cooperating recording medium or print support 9, there is provided means for converting the rotary motion of the bearing element 5 and, thereby, of the operating element 6 into a translational movement of the printing head. To this end, a transverse eccentric 7 is provided about the upper end of the bearing element 5 for relative rotational movement thereabout. The eccentric 7 is received in a recess defined by a skeleton framework or surface 12 formed on the printing head 1 for engagement thereagainst. The eccentric 7 is connected for rotation with the pin 5 and its relative movement against the cooperating surface of the skeleton framework causes a camming action which displaces the printing head 1 on the carriage relative to the print support 9 in a direction orthogonal to the longitudinal axis of the print support 9. During this movement, the pegs 3 travel in the carriage guideways.

A locking nut 10 is also threadably and adjustably attached to the pin 5 such that the eccentric 7 is between the nut 10 and the operating element 6. Tightening of the nut 10 against the eccentric 7 fixes the eccentric 7 in position for rotation with the pin 5. A basic positioning of the eccentric 7 may be made by the manufacturing factory when the locking nut 10 is originally tightened against the eccentric 7. Accordingly, a basic or factory adjusted spacing "a", as shown in FIG. 2, is defined between the printing head 1 and the cooperating print support 9 by the original setting of the eccentric 7 into a specific position relative to the bearing element 5. Subsequently, when the operating element 6 is turned into a specific clamping or locking position on the support surface 13 of the printing head 1, the printing head will be positioned spaced from the print support 9 by a distance determined by the camming action of the eccentric 7. The clamping engagement of the operating element 6, which is in the form of a spring lever, can be tightened by the use of a further locking nut 8 threadably disposed on the pin 5 over the element 6.

To enhance the clamping action of the operating element 6 on the support surface 13 of the printing head and to permit releasable locking of the printing head at predetermined spacings away from the print support, there is provided a plurality of catch recess K1, K2, and K3 on the support surface 13 into which a downwardly protruding tongue edge of the operating element 6 may be received. By means of turning the operating element 6 over the support surface 13 and finally engaging the operating element tongue into one of the catch recesses K1, K2, or K3, the eccentric 7 displaces the printing head 1 toward or away from the cooperating print support 9. With the eccentric 7 locked in a particular setting relative to the bearing element 5 by the locking nut 10 at the factory, different specific spacings between the printing head 1 and the cooperating print support 9 are thereby allocated to each respective catch recess K1, K2, and K3. The engagement of the tongue of the operating element 6 into the two catch recesses K1 and K2 enables the customer or user to select different spacings between the printing head and the cooperating print support depending on the thickness of the material to be printed, such as paper, or the number of copies being made. Additional catch recesses may be added to provide further possibilities of adjustment.

When the tongue of the operating element 6 enages in the catch recess K3, then the printing head 1 is at such a great distance from the cooperating print support 9 that replacement of the ink ribbon is possible without getting the user's hands dirty.

The dotted line position of the operating element 6 as shown in the Figures indicates the positioning of the operating element when the printing head 1 and the carriage 2 are no longer secured to one another, such that the printing head 1 may be replaced.

Although various minor modifications may be suggested by those versed in the art, it should be understood that I wish to embody within the scope of the patent warranted hereon all such modifications as reasonably and properly come within the scope of my contribution to the art.

I claim as my invention:

1. In a printing machine in which a printing head is releasably disposed on a carriage across from a recording medium support, apparatus for mounting the printing head to the carriage comprising a pin means mounted upstanding from said carriage and disposed for rotation, a clamping element seated at the upper end of said pin means for selectively engaging against a support surface formed on said printing head to hold said printing head on said carriage and an eccentric connected to said pin means for engaging with a cooperating surface formed on said printing head such that rotation of said pin means brings said clamping element into engagement with the support surface of said printing head and causes said eccentric to selectively displace said printing head on the carriage relative to said recording medium support.

2. The apparatus of claim 1, wherein said eccentric is seated for rotation on said pin means.

3. The apparatus of claim 2, further comprising means for adjustably seating said eccentric on said pin means.

4. The apparatus of claim 2, wherein said clamping element is in the form of a spring lever having a tongue portion and said support surface is formed with a plurality of spaced apart catch recesses for selectively receiving said tongue portion upon mounting of the printing head to said carriage.

5. The apparatus of claim 4, wherein said spring lever is disposed over said eccentric and further comprising means for adjustably pressing said spring lever against said eccentric.

6. The apparatus of claim 1, further comprising resilient means for biasing said clamping element toward said carriage.

7. The apparatus of claim 6, wherein said resilient means comprises a spring acting between the lower end of said pin means and the undersurface of said carriage.

8. The apparatus of claim 1, wherein said clamping element is in the form of a spring lever having a tongue portion and said support surface is formed with a plurality of spaced apart catch recesses for selectively receiving said tongue portion upon mounting of the printing head to said carriage.

9. The apparatus of claim 8, wherein one of said catch recesses is positioned on said support surface such that engagement thereof with said clamping element tongue portion causes said eccentric to become rotated to an extent that said printing head is sufficiently displaced from said recording medium support to permit unencumbered threading of an ink ribbon in said printing machine.

10. The apparatus of claim 1, wherein said cooperating surface defines a recess about said eccentric.

* * * * *